US005330193A

United States Patent [19]

Ijiri

[11] Patent Number: 5,330,193

[45] Date of Patent: Jul. 19, 1994

[54] GOLF SWING PRACTICING ARTICLE

[76] Inventor: Yasuhiro Ijiri, 4-28-203, Terauchi 1-chome, Toyonaka-shi, Osaka, Japan

[21] Appl. No.: 980,998

[22] Filed: Nov. 24, 1992

[30] Foreign Application Priority Data

Nov. 30, 1991 [JP] Japan ..... 3-114343[U]
Jan. 10, 1992 [JP] Japan ..... 4-18422[U]

[51] Int. Cl.[5] ..... A63B 69/36

[52] U.S. Cl. ..... 273/193 A; 482/109; 273/171

[58] Field of Search ..... 273/193 A, 193 R, 194 R, 273/194 A, 194 B, 186.2, 171; 482/109

[56] References Cited

U.S. PATENT DOCUMENTS 875,273 12/1907 Kimble ..... 482/109 X
1,524,196 1/1925 Matthews ..... 273/193 A
3,231,281 1/1966 Wallo ..... 273/193 A
3,743,297 7/1973 Dennis ..... 273/193 A
4,118,033 10/1978 Miyamoto ..... 273/186 A
4,819,935 4/1989 Dirksing et al. ..... 273/193 A X
5,026,063 6/1991 Rhodes ..... 273/193 A X
5,083,790 1/1992 Wheatley ..... 273/193 A

*Primary Examiner*—George J. Marlo
*Attorney, Agent, or Firm*—George J. Brandt, Jr.; Thomas R. Morrison

[57] ABSTRACT

A golf swing practicing article which is shorter in overall length than an ordinary golf club and substantially symmetrical around a center axis of a shaft body includes a grip member disposed at first end section of the shaft body and a weight member at an opposite second shaft body end section, the weight member increasing the mass at the said second end section, the weight member occupying 40 to 60% of said overall length. The weight member can have a tapered portion and a receiving portion for reception and removal of weights so as to vary the weight of the weight section, the weights being cylindrical members of different sizes and such that certain of same fit inside others of the weights.

11 Claims, 4 Drawing Sheets

GOLF SWING PRACTICING ARTICLE

BACKGROUND OF THE INVENTION

1. Field of the Invention

The present invention relates to a golf swing practicing article which is shorter in overall length than an ordinary golf club.

2. Description of the Prior Art

In golf, one of the very effective techniques for driving the ball accurately is to swing the club in the so-called level swing style, which means to swing the club in such a manner that the golf player's shoulders and waist turn in given planes which are substantially perpendicular to a given swing axis.

However, it is by no means easy for ordinary golfers to practice this level swing in the swing of the golf club. The reason is that since the golf club has a head at the distal end of its shaft, the center of gravity deviates from the center axis of the shaft and grip of the club, causing the golfer to be conscious of the head which strikes the ball, said head deviating from the center axis of the shaft and grip. Therefore, in a swing practice using an ordinary club, realization of the level swing cannot be said to be easy.

Various swing practicing articles have heretofore been invented which are shorter in overall length than ordinary clubs to make it possible to practice even in narrow spaces. In such swing practicing articles, the mass in the distal portion is made greater than the mass of the ordinary club head in order to make the sensational weight in swing closer to that associated with the ordinary club. Such measure, however, results in excessive mass being concentrated in the distal portion only to cause the danger of the swing sensation obtained deviating from the ordinary swing sensation. Further, in that case, the shape of the distal portion is enlarged almost necessarily in accordance with the mass and hence the golfer takes the distal portion as the head, excessively concentrating his sensation on the distal portion, obstructing realization of the level swing.

OBJECTS AND SUMMARY OF THE INVENTION

An object of the present invention is to provide a golf swing practicing article shorter in overall length than an ordinary golf club to allow practice in narrow spaces, wherein the sensation obtained by swinging the article is close to the ordinary swing sensation and the article allows the user to practice the level swing easily and reliably.

To achieve said object, the golf swing practicing article of the invention comprises a shaft body, a grip portion at the proximal end of said shaft body, a weight section spaced from the grip position on the grip portion and connected to the distal side of the shaft body to increase the mass in the distal side, said article being shorter in overall length than an ordinary golf club and being substantially rotation-symmetrical around the centeraxis of the shaft body, wherein said weight section occupies 40 to 60% of the overall length in the distal side, the proximal portion of the weight section is a tapered portion with its outer diameter gradually increased toward the distal end, and the portion extending from the tapered portion toward the distal side has a substantially constant outer diameter.

Further, said weight section may be tapered throughout the length.

The golf swing practicing article of the present invention has its mass gradually increased toward the distal end. Since the mass of the distal side is high, the sensational weight in swing can be made the same as in ordinary golf clubs and the sense of incompatibility which would otherwise be caused by concentration of excessive mass on the distal portion can be avoided and the natural way of turning back the wrists can be easily learned. Since the weight section is located on the distal side of the shaft body and spaced from the grip position, the flexing of the shaft body during swing can be felt to some degree and the swing sensation obtained is closer to the ordinary one.

Further, the weight section is substantially rotation-symmetrical, the center of gravity substantially coincides with the center axis of the shaft body and grip portion, and the distribution of mass is substantially rotation-symmetrical about said center axis. As a result, there is no physical factor which disturbs the paths of the turning of the shoulders and waist or the path of the swing.

Besides this, the whole including the weight section is substantially rotation-symmetrical and the proximal portion of-the weight section is tapered with its outer diameter gradually increased toward the distal end; therefore, unlike the case where the weight section is located only in the distal portion or is nonsymmetrical, the person who practices is not forced to be conscious of only one region of the weight section or one direction alone and instead his sensation is directed to the weight section throughout the length occupying 40 to 60% of the overall length in the distal side. Therefore, there is no sensational factor which disturbs the paths of the turning of the shoulders and waist or the path of the swing. Further, the path of the swing can be easily ascertained from the overall length of the weight section.

Despite the fact that the golf swing practicing article of the present invention is shorter in overall length than ordinary golf clubs, the sensation obtained by swinging the article is close to the ordinary swing sensation, and the natural way of turning back the wrists can be easily learned. Further, physically or sensationally there is no factor which disturbs the path of swing and the path of swing can be easily ascertained from the overall length of the weight section. Therefore, the use of this golf swing practicing article allows the user to practice the level swing easily and reliably even in narrow spaces.

In the golf swing practicing article of the invention, said shaft body is inserted in said weight section and the shaft body and weight section are connected together in the region spaced from the proximal end of the weight section toward its distal end by 30% or more of the overall length of the weight section, it being preferable that in the region extending from the connected portion toward the proximal end, the shaft body and weight section be substantially in the non-fixed state.

With the golf swing practicing article arranged in this manner, in the region extending from the connected portion toward the proximal end, the shearing force which can act between the shaft body and weight section is small, so that the bending rigidity of the shaft body does not increase so much. Therefore, during swing movement, the shaft body tends to flex in not only the region extending from the grip position on the grip portion to the proximal end of the weight section but also in the region extending from the proximal end of the weight section to the connected portion. Since the weight section occupies 40 to 60% of the overall length in the distal side, the portion of the shaft body extending from the grip position to the proximal end of the weight section is relatively short but the length tending to flex in the shaft body is such that the weight of the weight section can be fully felt during swing.

Therefore, in the golf swing practicing article arranged in this manner, despite the facts that the overall length is less than that of an ordinary golf club and that the portion of the shaft body extending from the grip position in the grip portion to the weight section is relatively short with the weight section occupying 40 to 60% of the overall length in the distal side, the portion of the shaft body which tends to flex extends from the grip position in the grip portion to the position of the connected portion, that is, it extends to the position in the distal side of the weight section spaced from the proximal end of the weight section by 30% or more of the overall length of the weight section; therefore, during swing the weight of the weight section, i.e., the head can be fully felt or perceived. Therefore, as compared with an article in which the shaft body and weight section are fixed together or integrated, the swing practice can be made with a sensation very close to the ordinary golf swing sensation, facilitating the level swing practice.

Further, in the golf swing practicing article of the present invention, said weight section preferably has at its distal end a receiving portion for reception and removal of weight means and increase and decrease in the number of weight members forming said weight means.

In the golf swing practicing article arranged in this manner, reception or removal of such weight means and increase or decrease in the number of said weight members make it possible for, after individual users to adjust the weight for the swing according to the their muscular strengths and swing sensations. Setting the weight at a somewhat higher value makes it possible to use the practicing article to increase the muscular strength necessary for swing. Therefore, the level swing can be practiced easily and reliably in narrow spaces to increase the muscular strength so as to promote the result of swing practice.

Further, the golf swing practicing article, described has weight means receivable in said receiving portion, said weight means comprising a first weight member in the form of a bottomed cylinder and a second weight member in the form of a cylinder, said first weight member being adapted to be held in the receiving portion coaxially with the practicing article body substantially without any play whether the bottom of said first weight member is directed to the distal side or the proximal side of the practicing article body, said second weight member being, in the first weight member, adapted to be held in said first weight member coaxially with the practicing article body substantially without any play.

In the golf swing practicing article arranged in this manner, the weight means is substantially rotation-symmetrical. Whether the body alone is used or the weight means is received in the receiving portion, the center of gravity of the whole coincides with the center axis of the shaft body and grip portion, and the distribution of mass is substantially rotation-symmetrical around the center axis. Whether the first weight member alone is used or the second weight member is inserted in the first weight member, such weight members can be held in the receiving portion substantially without any play. In the case of the first weight member alone, the position of the center of gravity can be changed by positioning its bottom on the distal side or, reversely, on the proximal side, so as to further minutely adjust the weight for swing.

Further, the golf swing practicing article has weight means received in said receiving portion, said weight means comprising first through nth weight members (where n is an integer not less than 2) in the form of bottomed cylinders, the first weight member being adapted to be held in the receiving portion coaxially with the practicing article body substantially without any play whether the bottom of the first weight member is directed to the distal side or proximal side of said practicing article body, the mth weight member (where m being an integer not less than 2 but not more than n) being, in the (m−1)st weight member, adapted to be held in the receiving portion coaxially with the practicing article body substantially without any play whether their bottoms are directed to the distal side or proximal side of the practicing article body.

In the golf swing practicing article arranged in this manner, the weight means is substantially rotation-symmetrical. Whether the practicing article body alone is used or the weight means is received in the receiving portion, the center of gravity of the whole coincides with the center axis of the shaft body and grip portion, and the distribution of mass is substantially rotation-symmetrical around the center axis.

Further, whether the first weight member alone is used or the second weight member is inserted in the first weight member or the second through mth weight members are respectively inserted in the first through (m−1)st weight members, such weight members can be held in the receiving portion substantially without any play. And the position of the center of gravity can be changed by positioning the bottom of the weight means on the distal side or, reversely, on the proximal side, so as to further minutely adjust the weight for swing. For example, where the first through mth weight members are used, the weight for swing can be maximized or minimized by positioning the bottoms of all weight members on the proximal side or on the distal side, respectively. Further, if only some of the weight members are positioned at their bottoms on the proximal side, a medium degree of weight can be obtained.

Further, the golf swing practicing article of the present invention, includes weight means receivable in said receiving portion, said weight means comprising first through nth weight members in the form of bottomed cylinders (where n is an integer not less than 2) and a (n+1)st weight member in the form of a cylinder, said first weight member being adapted to be held in the receiving portion coaxially with the practicing article body substantially without any play whether the bottom of the first weight member is directed to the distal side or proximal side of said practicing article body, the mth weight member (where m being an integer not less than 2 but not more than n) being, in the (m−1)st weight member, adapted to be held in the receiving portion coaxially with the practicing article body substantially without any play whether their bottoms are directed to the distal side or proximal side of the practicing article body, the (n+1)st weight member being, in the nth weight member, adapted to be held in the receiving portion coaxially with the practicing article body substantially without any play.

In the golf swing practicing article arranged in this manner, the weight means is substantially rotation-symmetrical. Whether the practicing article body alone is used or the weight means is received in the receiving portion, the center of gravity of the whole substantially coincides with the center axis of the shaft body and grip portion and the distribution of mass is substantially rotation-symmetrical around the center axis.

Further, whether the first weight member alone is used or the second weight member is inserted in the first weight member or whether the second through mth weight members are respectively inserted in the first through (m−1)st weight members or the second through (n+1)st weight members are respectively inserted in the first through nth weight members, such weight members can be held in the receiving portion without any play. The position of the center of gravity can be changed by positioning the bottoms of the firth through nth weight members on the distal side or, reversely, on the proximal side, so as to further minutely adjust the weight for swing.

In the golf swing practicing articles, the distribution of mass also can be substantially rotation-symmetrical around the center axis of the article and the practicing article body including the weight section is also substantially rotation-symmetrical. Further, since the proximal portion of the weight section or all the weight section is tapered with its outer diameter gradually increased toward the distal end, physically or sensationally there is no factor which disturbs the path of swing and, moreover, the path of swing can be easily ascertained from the overall length of the weight section.

Further, the weight for swing can be adjusted according to the user's muscular strength and swing sensation, and by setting the weight at a somewhat higher value, the muscular strength necessary for swing can be simultaneously increased.

Therefore, if this golf swing practicing article is used, the level swing can be practiced easily and reliably in narrow spaces, and the result of swing practice can be further promoted by the increase in muscular strength.

DESCRIPTION OF THE PREFERRED EMBODIMENTS

Figure 1:
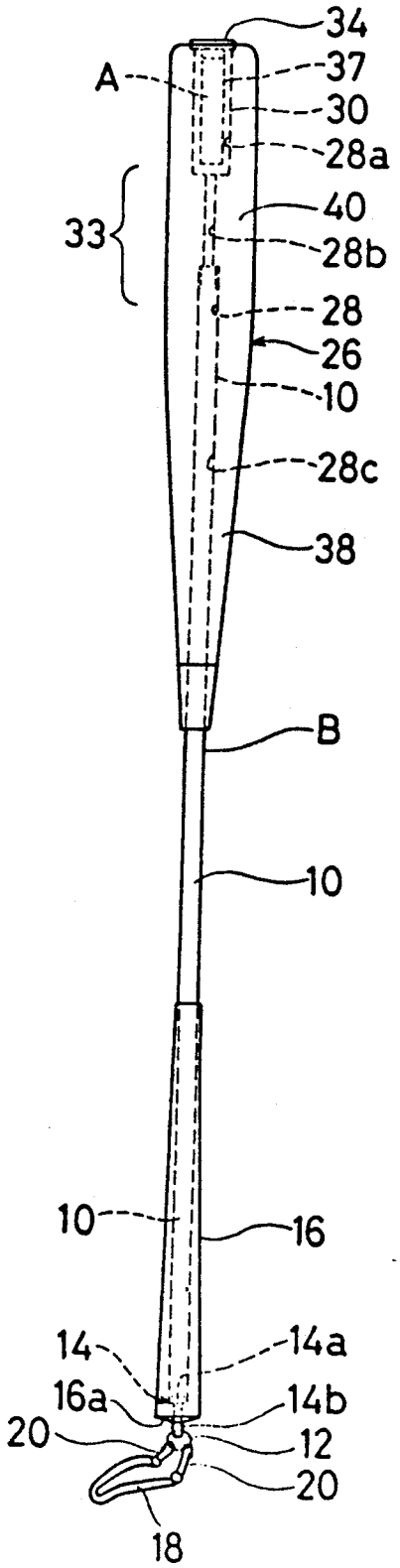
FIG. 1 is a front view of a golf swing practicing article according to an embodiment of the present invention.
Figure 2:
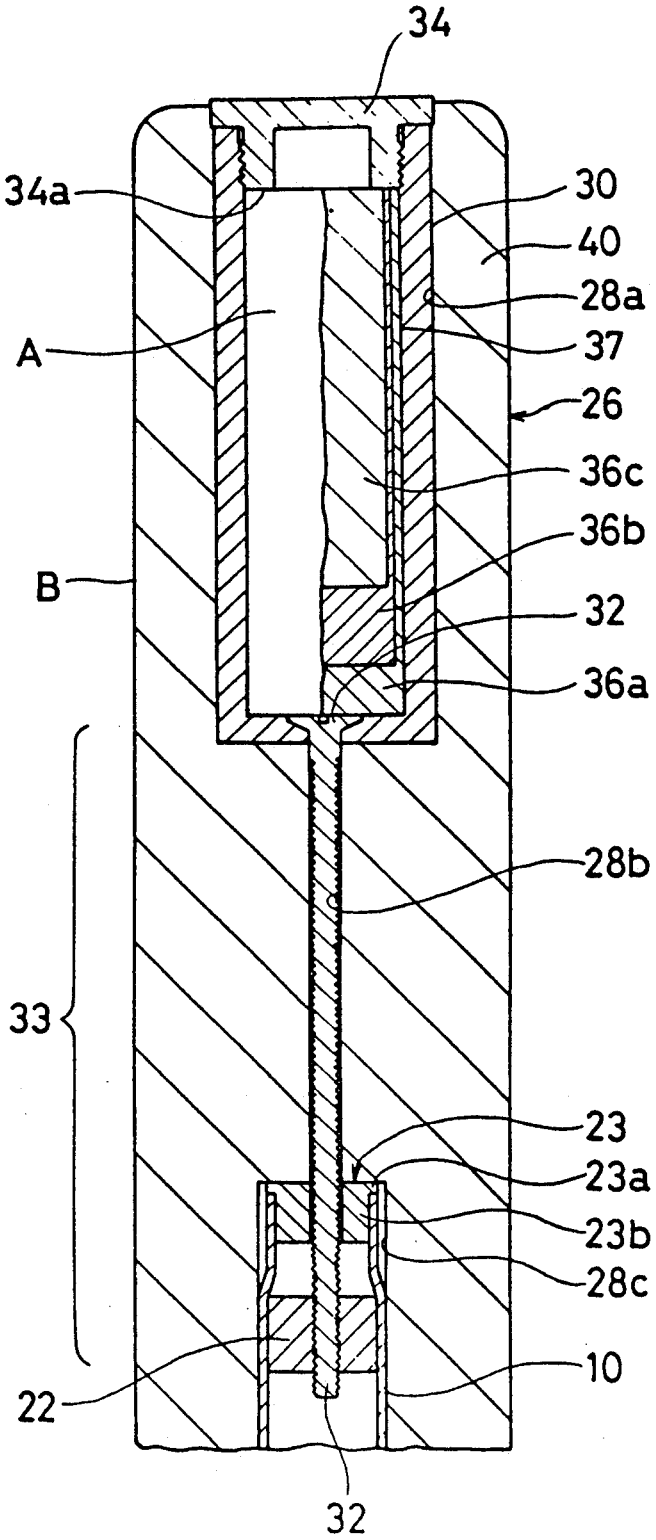
FIG. 2 is a sectional view of the principal portion of the swing practicing article according to said embodiment of the present invention.

In FIGS. 1 and 2 showing golf swing practicing article according to an embodiment of the present invention, the numeral 10 denotes a shaft. The shaft 10 is a cylindrical steel pipe having the same degree of bending rigidity as that of a golf club shaft. Of course, the material is not limited thereto. For example, various materials, such as carbon fiber, graphite and the like used for golf club shafts, may be used. A holding member 14 for holding a ring member 12 is fitted at its large diameter portion 14*a* in the proximal end of the shaft 10, and a grip member 16 for golf clubs is fitted on and connected to the proximal portion including the proximal end of the shaft 10. The grip position is adjacent the proximal portion of the grip member 16. The small diameter portion 14*b* of the holding member 14 extends through the bottom 16*a* of the grip member 16 to be exposed beyond the grip end, the exposed portion having the ring member 12 held thereat. The numeral 18 denotes a slippage-preventive cord connected at its opposite ends to the ring member 12 through removable connecting members 20. The user puts said slippage-preventive cord 18 on his wrist when he practices swing, thereby preventing an accident in which the hand slips off the practicing article to let the latter fly, causing breakage or personal injury.

A nut 22 is threadedly fitted on the distal end of the shaft 10 and the shaft 10 is crimped at its region disposed forwardly of said nut 22 to prevent the latter from slipping off the distal end of the shaft 10. An annular member 23 having a flange portion 23*a* is fitted at its body portion 23*b* in the crimped distal end of the shaft 10, with the flange portion 23*a* contacted with the distal end surface of the shaft 10.

The numeral 26 denotes a weight section which is substantially rotation-symmetrical. The weight section 26 is formed with a through-hole 28 extending through the center thereof. The distal portion of the through-hole 28 is a large diameter portion 28*a*, and the proximal side of said large diameter portion 28*a* terminates in a small diameter portion 28*b* and the proximal end of said small diameter portion 28*b* terminates in a medium diameter portion 28*c* having an inner diameter substantially equal to the outer diameter of the shaft 10. The distal end of the shaft 10 is clearance-fitted in the medium diameter portion 28*c* of the through-hole 28 with a little clearance which substantially produces no play. A cup member 30 of circular cross-section is fitted in the large diameter portion 28*a* in such a manner that it opens to the distal end. A fixing screw 32 extending through the bottom plate 30*a* of the cup member 30, small diameter portion 28*b* and annular member 23 is driven into the nut 22, whereby the portion of the weight section 26 around the small diameter portion 28*b* is held between the flange portion 23*a* of the annular member 23 and the bottom plate 30*a* of the cup member 30, and the cup member 30 and shaft 10 are fixedly connected to the weight section 26. The portion which covers the bottom plate 30*a* of the cup member 30, the small diameter portion 28*b*, the annular member 23 and the nut 22 is the connected portion 33.

In addition, in this embodiment, the shaft 10 is clearance-fitted in the medium diameter portion 28*c* with a little clearance throughout the length between the connected portion 33 and the proximal end of the weight section 26. However, there is no trouble even if there are some portions having large clearances and other portions having no clearance, provided that there is substantially no play between the shaft 10 and the weight section 26 and that the portion of the shaft 10 which is clearance-fitted in the medium diameter portion 28*c* causes no problem except that it tends to flex. Further, where it is fixed through an elastic material such as rubber, there is no trouble provided that there is substantially no play and that the portion of the shaft 10 which is clearance-fitted in the medium diameter portion 28*c* causes no problem except that it tends to flex.

A lid member 34 is threadedly engaged with the opening in the cup member 30, thereby defining in the cup member 30 a receiving portion 37 for reception and removal of weight means A and increase and decrease in the number of weight members forming said weight means.

The proximal portion of the weight section 26 is a tapered portion 38 with its outer diameter gradually increased toward the distal end, and the distal portion is a constant diameter portion 40 with its outer diameter being substantially constant. For the material of the weight section 26, use may be made of wood, synthetic resins, metals and the like.

The overall length of the golf swing practicing article is preferably about 60 to 80 cm. In this embodiment, the weight section 26 occupies about 50% of the overall length and there is a space between the weight section 26 and the grip portion 16, said space being about 20% or more of the overall length.

As shown in FIG. 2, the weight means A in this embodiment comprises first and second weight members 36*a* and 36*b* in the form of bottomed cylinders and a third weight member 36*c* in the form of a cylinder.

The outer diameter of the first weight member 36*a* is slightly smaller than the inner diameter of the cup member 30 and the length of the first weight member 36*a* is substantially equal to the distance between the annular end surface 34*a* of the lid member 34 threadedly engaged with the opening in the cup member 30 and the inner bottom surface of the cup member 30. Further, the inner diameter of the first weight member 36*a* is smaller than the outer diameter of the annular end surface 34*a* and greater than its inner diameter.

The outer diameter of the second weight member 36*b* is slightly smaller than the inner diameter of the first weight member 36*a* and the length of the second weight member 36*b* is substantially equal to the distance between the inner bottom surface of the first weight member 36*a* and its opening. Further, the inner diameter of the second weight member 36*b* is greater than the inner diameter of the annular end surface 34*a* of the lid member 34.

The outer diameter of the third weight member 36*c* is slightly smaller than the inner diameter of the second weight member 36*b*, and the length of the third weight member 36*c* is substantially equal to the distance between the inner bottom surface of the second weight member 36*b* and its opening. Further, the outer diameter of the third weight member 36*c* is greater than the inner diameter of the annular end surface 34*a*.

Therefore, whether the first weight member 36*a* alone is used or the second weight member 36*b* is inserted in the first weight member 36*a* or whether the third weight member 36*c* is inserted in the second weight member 36*b*, these weight members are held in the receiving portion 37 substantially without any play. It does not matter whether the bottoms of the first and second weight members 36*a* and 36*b* are directed to the distal side or proximal side of the practicing article body B. In addition, in FIG. 2, the bottoms of the first and second weight members 36*a* and 36*b* are directed to the proximal side of the practicing article body B.

The reception and removal of weight means A in the receiving portion 37 and increase and decrease in the number of weight members make it possible for individual users to adjust the weight for swing according to their muscular strengths and swing sensations. Further, by setting the weight at a somewhat higher value, the article can be used to increase the muscular strength needed for swing. By positioning the bottoms of the first and second weight members 36*a* and 36*b* on the distal side or, reversely, on the proximal side, the position of the center of gravity can be changed to thereby further minutely adjust the weight for swing.

The proximal portion of the weight section 26 is a tapered portion 38 and the portion disposed forwardly thereof is a constant diameter portion 40; therefore, the mass of the practicing article body B of the golf swing practicing article is gradually increased toward the distal end. The overall weight with the weight means A received in the receiving portion 37 is also gradually increased toward the distal end. In either case, by increasing the mass in the distal side in this manner, the sensational weight for swing is made the same as in an ordinary golf club. Further, since the mass is gradually increased toward the distal end, there is no danger of the swing sensation deviating from the ordinary swing sensation owing to the concentration of too much mass on the distal end, and a natural way of turning back the wrists can be easily learned.

Further, there is some distance between the weight section 26 and the grip position in the grip member 16 and the weight section 26 is disposed at the distal side of the shaft 10. The shaft 10 is inserted in the weight section 26 and is connected to the latter in a region spaced about 70% or more of the overall length of the weight section 26 from the proximal end toward the distal end.

The shaft 10 and the weight section 26 may be fixed together in a region spaced from the connected portion 33 toward the proximal end, but in this embodiment, in a region spaced from the connected portion 33 toward the proximal end, the shaft 10 and the weight section 26 are clearance-fitted together with a little clearance defined therebetween; therefore, the shearing force which can act between the shaft 10 and the weight section 26 in the region spaced from the connected portion toward the proximal side is small and the bending rigidity of the shaft 10 does not increase so much. Therefore, during the swing, the shaft 10 tends to flex not only in the region extending from the grip position in the grip member 16 to the proximal end of the weight section 26 but also in the region extending from the proximal end of the weight section 26 to the connected portion 33.

Since the weight section 26 occupies about 50% of the overall length in the distal side, the portion of the shaft 10 extending from the grip position to the proximal end of the weight section 26 is relatively short, but the portion of the shaft 10 which tends to flex is longer than this by about 70% of the overall length of the weight section 26, so that the weight of the weight section 26 can be fully felt during the swing.

Further, the weight section 26 and the weight means A are substantially rotation-symmetrical, and whether the practicing article body B alone is used or the weight means A is received in the receiving portion 37, the center of gravity of the whole substantially coincides with the center axis of the shaft 10 and grip member 16, and the distribution of mass is also substantially rotation-symmetrical around said center axis. Therefore, there is no physical factor which disturbs the paths of turning of the shoulders and waist.

Besides this, the whole including the weight section 26 and shaft 10 is substantially rotation-symmetrical and the proximal portion of the weight section 26 is a tapered portion 38 with its outer diameter gradually increased toward the distal end; therefore, the person who practices is not forced to be conscious of only one region of the weight section 26 or one direction alone and instead his sensation is directed to the weight section 26 throughout the length occupying 50% of the overall length in the distal side. Therefore, there is no sensational factor which disturbs the paths of the turning of the shoulders and waist or the path of the swing. Further, the path of the swing can be easily ascertained from the overall length of the weight section 26.

In addition, as for the connected portion 33, it is preferable that the shaft 10 and the weight section 26 be connected together in a region spaced from the proximal end of the weight section 26 by 50% or more of its overall length toward the distal end; more preferably, the spacing is 60% or more.

Further, it is not absolutely necessary that the tapered portion 38 and constant diameter portion 40 of the weight section 26 be of perfect taper and of strictly constant diameter, respectively; some discontinuity is allowed.

Figure 3:
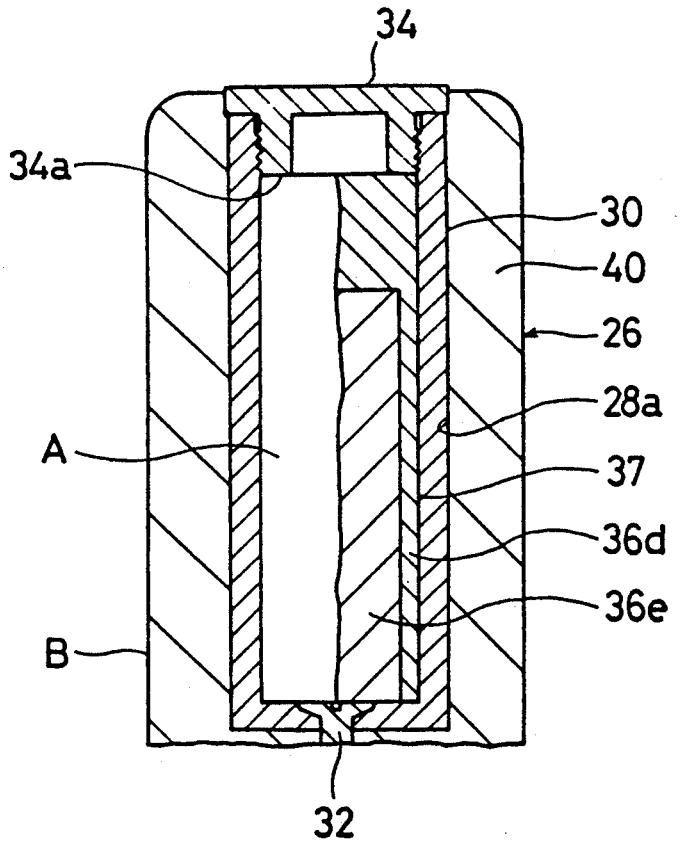
FIG. 3 is a sectional view of the principal portion of a swing practicing article according to another embodiment of the present invention.

In FIG. 3 showing a golf swing practicing article according to another embodiment of the present invention, the weight means A comprises a first weight member **36*d* in the form of a bottomed cylinder and a second weight member 36*e*** in the form of a cylinder.

The outer diameter of the first weight member **36*d* is slightly smaller than the inner diameter of the cup member 30 and the length of the first weight member 36*d* is substantially equal to the distance between the annular end surface 34*a* of the lid member 34 threadedly engaged with the opening in the cup member 30 and the inner bottom surface of the cup member 30. Further, the inner diameter of the first weight member 36*d* is smaller than the outer diameter of the annular end surface 34*a*** and greater than its inner diameter.

The outer diameter of the second weight member **36*e* is slightly smaller than the inner diameter of the first weight member 36*d* and the length of the second weight member 36*e* is substantially equal to the distance between the inner bottom surface of the first weight member 36*d* and its opening. Further, the outer diameter of the second weight member 36*e* is greater than the inner diameter of the annular end surface 34*a***.

Therefore, whether the first weight member **36*d* alone is used or the second weight member 36*e* is inserted in the first weight member 36*d*, these members are held in the receiving portion 37 substantially without any play. It does not matter whether the bottom of the first weight members 36*d* is directed to the distal side or proximal side of the practicing article body B. In addition, in FIG. 3, the bottom of the first weight member 36*a*** is directed to the distal side of the practicing article body B.

By positioning the bottom of the first weight member **36*d*** on the distal side or, reversely, on the proximal side, the position of the center of gravity can be changed to thereby further minutely adjust the weight for swing.

Figure 4:
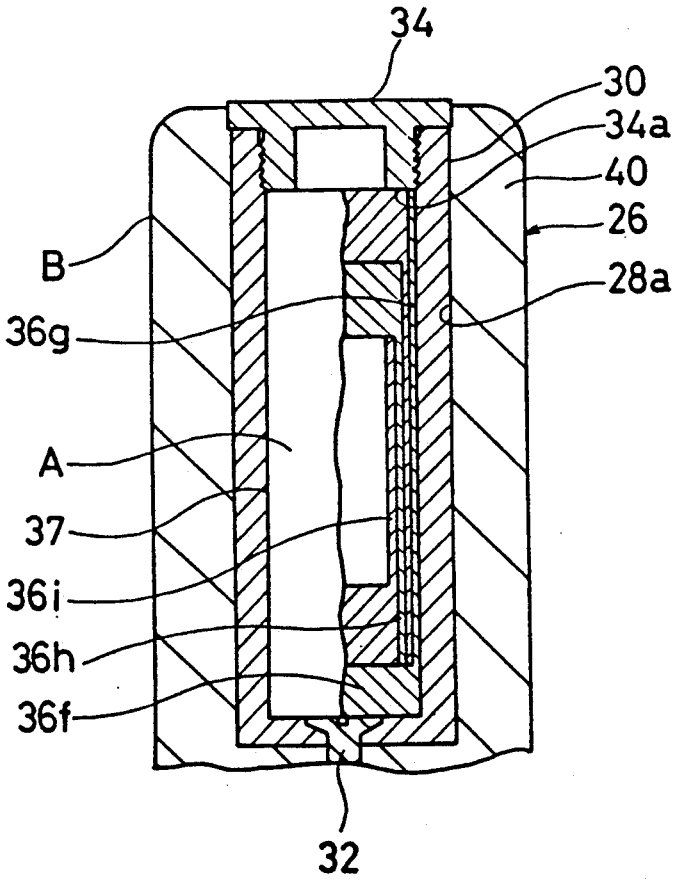
FIG. 4 is a sectional view of the principal portion of a swing practicing article according to yet another embodiment of the present invention.

In FIG. 4 showing a golf swing practicing article according to a further embodiment of the present invention, the weight means A comprises first through fourth weight members **36*f* through 36*i*** in the form of bottomed cylinders.

The outer diameter of the first weight member **36*f* is slightly smaller than the inner diameter of the cup member 30 and the length of the first weight member 36*f* is substantially equal to the distance between the annular end surface 34*a* of the lid member 34 threadedly engaged with the opening in the cup member 30 and the inner bottom surface of the cup member 30. Further, the inner diameter of the first weight member 36*f* is smaller than the outer diameter of the annular end surface 34*a*** and greater than its inner diameter.

The outer diameter of the second weight member **36*g* is slightly smaller than the inner diameter of the first weight member 36*f* and the length of the second weight member 36*g* is substantially equal to the distance between the inner bottom surface of the first weight member 36*f* and its opening. Further, the inner diameter of the second weight member 36*g* is greater than the inner diameter of the annular end surface 34*a***.

The outer diameter of the third weight member **36*h* is slightly smaller than the inner diameter of the second weight member 36*g* and the length of the third weight member 36*h* is substantially equal to the distance between the inner bottom surface of the second weight member 36*g* and its opening. Further, the outer diameter of the third weight member 36*h* is greater than the inner diameter of the annular end surface 34*a***.

The outer diameter of the fourth weight member **36*i* is slightly smaller than the inner diameter of the third-weight member 36*h* and the length of the fourth weight member 36*i* is substantially equal to the distance between the inner bottom surface of the third weight member 36*h* and its opening. Further, the outer diameter of the fourthweight member 36*i* is greater than the inner diameter of the annular end surface 34*a***.

Therefore, whether the first weight member **36*f* alone is used or the second weight member 36*g* is inserted in the first weight member 36*f*, whether the third weight member 36*h* is inserted in the second weight member 36*g* or whether the fourth weight member 36*i* is inserted in the third weight member 36*f*, these members are received and held in the receiving portion 37 substantially without any play. It does not matter whether the bottoms of the first through fourth weight members 36*f* through 36*i* are directed to the distal side or proximal side of the practicing article body B. In addition, in FIG. 4, the bottoms of the first and fourth weight members 36*f* and 36*i* are directed to the proximal side of the practicing article body B and the bottoms of the second and third weight members 36*g* and 36*h*** are directed to the distal side of the practicing article body B.

By positioning the bottoms of the first through fourth weight members **36*f* through 36*i*** on the distal side or, reversely, on the proximal side, the position of the center of gravity can be changed to thereby further minutely adjust the weight for swing.

What is claimed is:

1. A golf swing practicing article comprising a shaft body having first and second ends and the same degree of bending rigidity as that of an ordinary golf club, a grip carried on a first end section of said shaft body, a weight member carried at an opposite second end section of the shaft body for increasing the article mass at said second end section, said article having an overall length less than that of said ordinary golf club and being substantially symmetrical around a center axis of the shaft body, said weight member occupying 40 to 60 % of said overall length, and the weight member comprising a first portion and a second portion, the first portion being proximal the shaft body first end section and tapering outwardly of the shaft body center axis in a direction away from said shaft body first end section, the weight member second portion being distal the shaft body first end section and having a substantially constant outer diameter, an end part of the weight member second portion remote from the first portion thereof having a recess wherein weights can be removably received.

2. A golf swing practicing article in accordance with claim 1 further comprising a plurality of weights, a first of said weights being removably receivable in said recess and a second of said weights being removably nestable in a passage in the first weight, any succeeding weight in the plurality being removably nestable in a passage in the preceding weight, the first weight being receivable in the recess such and a weight nestable in another weight such that no play exists therebetween.

3. A golf swing practicing article in accordance with claim 2 in which an external surface of the first weight and an internal surface of the recess conform one with the other, and an external surface of a weight and the internal surface of a weight passage wherein said weight is nestable conform one with the other.

4. A golf swing practicing article in accordance with claim 3 in which the first weight is a hollow cylinder having a bottom wall at an end thereof.

5. A golf swing practicing article in accordance with claim 4 in which the second weight and any succeeding weight in the plurality are hollow cylinders having a bottom wall at an end thereof.

6. A golf swing practicing article in accordance with claim 5 in which the weights are arranged in a nesting wherein the bottom wall of at least one weight is located proximal an entry to said recess and the bottom wall of at least one of other weights is located remote from said recess entry.

7. A golf swing practicing article in accordance with claim 5 in which the weights are nestable such that axes of the weights are coaxial with the shaft body center axis.

8. A golf swing practicing article in accordance with claim 4 in which the second weight and any succeeding weight in the plurality except a last such weight of the plurality are hollow cylinders having a bottom wall at an end thereof, said last such weight being a solid cylinder.

9. A golf swing practicing article in accordance with claim 8 in which the weights are nestable such that axes of the weights are coaxial with the shaft body center axis.

10. A golf swing practicing article in accordance with claim 4 in which said second weight is a solid cylinder.

11. A golf swing practicing article in accordance with claim 1 in which the shaft body is received in the weight member and connected thereto along a region spaced from a tip end of said shaft body second opposite end section which is at least about 30% or more of the overall length of the weight member, a shaft body length intervening said connector region and said shaft body first end section being unconnected with said weight member.

* * * * *